US008685603B2

(12) United States Patent
Kiyono et al.

(10) Patent No.: US 8,685,603 B2
(45) Date of Patent: Apr. 1, 2014

(54) ELECTROSTATIC CHARGE IMAGE DEVELOPER, PROCESS CARTRIDGE AND IMAGE FORMING APPARATUS

(75) Inventors: Fusako Kiyono, Kanagawa (JP); Taichi Yamada, Kanagawa (JP); Yosuke Tsurumi, Kanagawa (JP); Akira Matsumoto, Kanagawa (JP); Akihiro Iizuka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 726 days.

(21) Appl. No.: 12/166,743

(22) Filed: Jul. 2, 2008

(65) Prior Publication Data

US 2009/0111042 A1 Apr. 30, 2009

(30) Foreign Application Priority Data

Oct. 30, 2007 (JP) ..... 2007-281337

(51) Int. Cl.
*G03G 9/093* (2006.01)

(52) U.S. Cl.
USPC ..... 430/108.7; 430/111.1; 430/108.22; 430/124.1; 430/137.14; 430/110.2

(58) Field of Classification Search
USPC ..... 430/108.21, 108.22, 124, 137.14, 430/110.2, 108.7
See application file for complete search history.

(56) References Cited

U.S. PATENT DOCUMENTS

2003/0175609 A1* 9/2003 Combes et al. ..... 430/108.22
2003/0224275 A1* 12/2003 Shimojo et al. ..... 430/108.22
2005/0158646 A1* 7/2005 Sugama et al. ..... 430/110.2
2005/0175923 A1 8/2005 Nakazawa et al.
2005/0282078 A1 12/2005 Kataoka et al.
2006/0024604 A1 2/2006 Sugiura et al.
2006/0216084 A1 9/2006 Kojima et al.
2006/0251982 A1 11/2006 Iwatsuki et al.
2006/0292473 A1 12/2006 Kadokura et al.
2006/0292477 A1* 12/2006 Daimon et al. ..... 430/109.4

(Continued)

FOREIGN PATENT DOCUMENTS

CN 1652033 A 8/2005
CN 1710492 A 12/2005

(Continued)

OTHER PUBLICATIONS

Chinese Office Action issued in Chinese Patent Application No. 200810129794.6 dated Jan. 26, 2011 (with translation).

(Continued)

*Primary Examiner* — Mark F Huff
*Assistant Examiner* — Rashid Alam
(74) *Attorney, Agent, or Firm* — Oliff PLC

(57) ABSTRACT

An electrostatic charge image developer includes a toner containing an external additive and a carrier comprising a resin-coated layer formed on a surface of a core material. The average shape factor SF1 of the toner is from 125 to 135, the number of particles having shape factor SF1 of less than 125 is from 5% to 30% by number with respect to the total number of toner particles, the number of particles having shape factor SF1 of greater than 135 is from 5% to 30% by number with respect to the total number of toner particles, the scratch line width in a scratch strength test of the resin used in the resin-coated layer is from 80 μm to 200 μm, and the scratch depth is from 60 μm to 150 μm.

19 Claims, 2 Drawing Sheets

(56) References Cited

U.S. PATENT DOCUMENTS

| | | | | |
|---|---|---|---|---|
| 2007/0092823 | A1* | 4/2007 | Matsumura et al. | 430/124 |
| 2007/0184375 | A1* | 8/2007 | Ninomiya et al. | 430/108.21 |
| 2007/0212633 | A1* | 9/2007 | Yamagami | 430/137.14 |
| 2008/0070150 | A1* | 3/2008 | Kobayashi et al. | 430/111.32 |
| 2009/0053639 | A1* | 2/2009 | Shimmura | 430/106.2 |

FOREIGN PATENT DOCUMENTS

| | | | |
|---|---|---|---|
| CN | 1749868 | A | 3/2006 |
| CN | 1828453 | A | 9/2006 |
| CN | 1845010 | A | 10/2006 |
| CN | 1888984 | A | 1/2007 |
| JP | B2 3-22979 | | 3/1991 |
| JP | A 3-100661 | | 4/1991 |
| JP | A 3-251856 | | 11/1991 |
| JP | A 4-44043 | | 2/1992 |
| JP | A 6-148941 | | 5/1994 |
| JP | A 6-167832 | | 6/1994 |
| JP | A 6-288864 | | 10/1994 |
| JP | A 7-49584 | | 2/1995 |
| JP | A 9-62025 | | 3/1997 |
| JP | 2000267331 | A * | 9/2000 |
| JP | A-2000-267331 | | 9/2000 |
| JP | A 2003-190836 | | 7/2003 |
| JP | A 2005-099193 | | 4/2005 |
| JP | A-2005-202133 | | 7/2005 |
| JP | A-2005-274745 | | 10/2005 |
| JP | A-2006-091564 | | 4/2006 |
| JP | A 2006-293335 | | 10/2006 |

OTHER PUBLICATIONS

Feb. 8, 2011 Third Party Opposition filed in Japanese Patent Application No. 2007-281337 (with translation).

May 22, 2012 Notice of Reasons for Rejection issued in Japanese Application No. 2007-281337 with English-language translation.

* cited by examiner

ELECTROSTATIC CHARGE IMAGE DEVELOPER, PROCESS CARTRIDGE AND IMAGE FORMING APPARATUS

CROSS-REFERENCE TO RELATED APPLICATION

This application is based on and claims priority under 35 USC 119 from Japanese Patent Application No. 2007-281337, filed Oct. 30, 2007.

BACKGROUND

1. Technical Field

The present invention relates to an electrostatic charge image developer, a process cartridge and an image forming apparatus.

2. Related Art

In an electrophotography method, an electrostatic latent image is formed on an image holding member (photoreceptor) by charging and exposing, and then developed by a toner; subsequently, the developed image is transferred onto a transfer receiver, and fixed by heating or the like to obtain an image. Developers used in electrophotographic methods such as this are categorized into single component developers, where a toner obtained by dispersing a coloring agent in a binding resin is used singularly, and two component developers, comprising a toner and a carrier. In two component developers, the carrier performs functions such as agitation, transportation and charging of the developer, and since these functions are separate to those of the developer, the two component developer has excellent controllability and is used widely at present.

In recent years digital processing has been adopted as a means for achieving high image quality, enabling high speed processing of complex images. In this case, as the output image, an electrostatic latent image formed by an optical system must be reproduced with high fidelity, and accordingly, the particle size of toner therein has been steadily decreasing, accelerating activity in the field of high fidelity reproduction. On the other hand, there is a demand for the number of components to be reduced, to achieve miniaturization, and also for the lifetime of consumable articles to be extended, to achieve low costs. That is, there are demands for the developer to have improved functions and reliability. Furthermore, in order to achieve higher productivity, the speed of an image holding member has been increasing; and accordingly, in order to stably obtain high image quality, it has become very important to improve the respective processes of development, transferring, fixing and cleaning.

For example, in a cleaning process in which toner remaining on the photoreceptor is scraped by a cleaning blade, there is a problem in that small and spherical toner particles slip through the cleaning blade and appear on a subsequent image.

Furthermore, as the particle size of the toner decreases, it becomes more important to improve charging characteristics. During developing, as the particle size of the toner decreases, a charge amount per weight (q/m) becomes larger, and developing becomes more difficult. Accordingly, an electric field used for developing needs to be increased in order to obtain the same development amount. However, since the upper limit of this electric field is determined by the surface potential of the photoreceptor, a value greater than a particular potential value cannot be achieved. Therefore, in order to control a charging amount of the toner to obtain a particular development amount, the charging capacity of the carrier has to be controlled to be low, in order to reduce the q/m of the toner. However, when the particle size of the toner decreases, despite an increase in the q/m of the toner, a charging amount per one toner particle decreases. As a result, electrostatic adherence of the toner and carrier, that is, an imaging force, is reduced, and moreover, the toner tends to be separated from the carrier. As a result, scattering in a developing unit due to agitation, and fogging of a background portion tend to be caused.

During transfer, an electric field which is the reverse of a developing electric field is applied to facilitate the transfer of toner. However, in this case as well, when the charge of each toner particle is too small, transfer becomes difficult, resulting in unevenness or voids in a transfer image. Furthermore, regarding the adherence of the toner and the photoreceptor, or in other words, the force resulting from both the imaging force between the toner and photoreceptor, and the intermolecular force between the toner and photoreceptor, although imaging force decreases as the particle size is decreased, intermolecular force increases; accordingly, the ratio of non-electrostatic adherence increases. As a result, transfer by an transfer electric field becomes more difficult.

In order to obtain high quality images over a long period of time, it is very important to improve the charging properties of toner for which decreasing the particle size thereof has presented significant technical difficulties, and to achieve both improved development property and transferability, and furthermore inhibit the occurrence of in-machine contamination and fog over a long period of time.

SUMMARY

According to an aspect of the invention, there is provided an electrostatic charge image developer including a toner containing an external additive and a carrier comprising a resin-coated layer formed on a surface of a core material; an average shape factor SF1 of the toner being from 125 to 135; the number of particles having shape factor SF1 of less than 125 being from 5% to 30% by number with respect to the total number of toner particles; the number of particles having shape factor SF1 of greater than 135 being from 5% to 30% by number with respect to the total number of toner particles; a scratch line width in a scratch strength test of a resin used in the resin-coated layer being from 80 μm to 200 μm; and a scratch depth being from 60 μm to 150 μm.

BRIEF DESCRIPTION OF THE DRAWINGS

Exemplary embodiments of the present invention will be described in detail based on the following figures, wherein.

DETAILED DESCRIPTION

Figure 1:
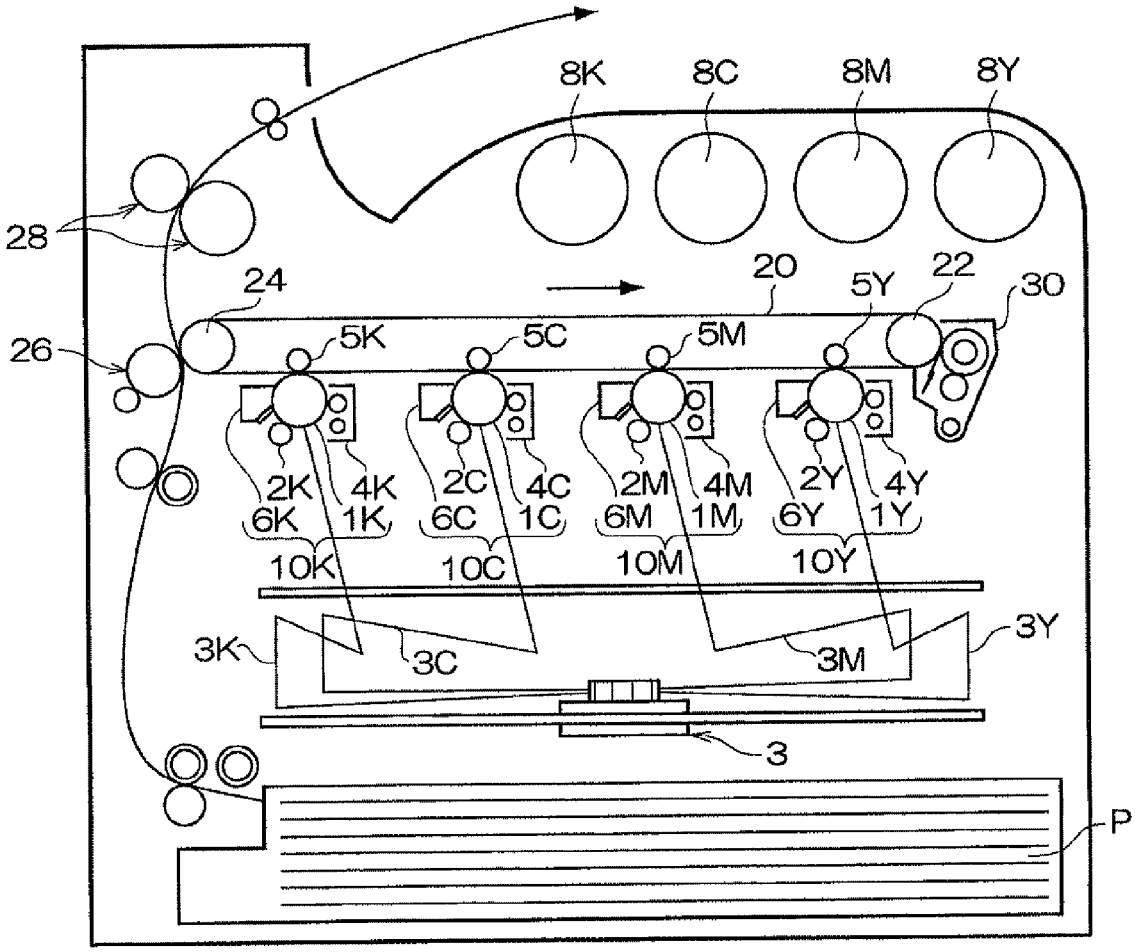
FIG. 1 is a schematic configurational diagram showing an example of an image forming apparatus of the invention.

Hereinafter, the invention will be described in detail.

(Electrostatic Charge Image Developer)

An electrostatic charge image developer (hereinafter, in some cases, simply referred to as "developer") of the invention includes a toner containing an external additive, and a carrier having a resin-coated layer formed on a surface of a core material; the average shape factor SF1 of the toner being from 125 (or about 125) to 135 (or about 135); the number of particles having a shape factor SF1 of less than 125 (or about 125) with respect to the total number of toner particles being from 5% (or about 5%) to 30% (or about 30%); the number of particles having a shape factor SF1 of greater than 135 (or about 135) being from 5% (or about 5%) to 30% (or about 30%) with respect to the total number of toner particles; the scratch line width in a scratch strength test of the resin used in the resin-coated layer being from 80 μm (or about 80 μm) to 200 μm (or about 200 μm); and the scratch depth in the scratch strength test being from 60 μm (or about 60 μm) to 150 μm (or about 150 μm).

A resin having a scratch line width of from 80 μm to 200 μm and scratch depth of from 60 μm to 150 μm in the scratch strength test is used in a resin-coated layer of the carrier.

The scratch line width is preferably from 90 μm to 180 μm and more preferably from 100 μm to 150 μm.

Furthermore, the scratch depth is preferably from 70 μm to 140 μm and more preferably from 80 μm to 120 μm.

The scratch strength test is carried out as shown below.

A resin to be measured is dissolved in a solvent (in the case of a developer, the carrier is dipped in a solvent to dissolve the covering resin after the toner is washed and separated), and is cast on a frosted stainless base material followed by drying, thereby, an evaluation sample is prepared (film thickness: approximately from 300 to 800 μm). The evaluation sample is set in a scratch strength tester (trade name: TRIBO-GEAR, produced by Shinto Kagaku Co., Ltd.) and the scratch test is carried out by using a needle of No. 7 at a load of 100 g, under the conditions of a needle traveling speed of 1500 mm/min and a travel distance of 50 mm. The line width and depth of the scratch are measured with a laser microscope (trade name: TK9500, produced by Keyence K. K.). When a film thickness is 300 μm or more, an underlayer does not affect on the result. The upper limit of 800 μm is adopted to make smaller the differences caused by variation in the experimental conditions.

The toner used in the invention is a toner with a broad shape distribution as mentioned above. Specifically, the average shape factor SF1 thereof is from 125 to 135, the proportion of the number of particles having a shape factor SF1 of less than 125 to the total number of the toner particles is from 5% to 30% and the proportion of the number of particles having a shape factor SF1 of greater than 135 is from 5% to 30%. The average shape factor SF1 is preferably from 126 to 134 and more preferably from 126 to 133.

The ratio of the number of particles having a shape factor SF1 of less than 125 to the total number of the toner particles is preferably from 5% to 25% and more preferably from 5% to 15%. Furthermore, the ratio of the number of particles having a shape factor SF1 of greater than 135 to the total number of the toner particles is preferably from 5% to 25%, and more preferably from 5% to 15%.

Here, the shape factor SF1 is obtained from a Formula (2) below.

$$SF1=(ML^2/A)\times(\pi/4)\times 100 \qquad \text{Formula (2):}$$

In the Formula (2), ML represents the absolute maximum length of a toner particle and A represents the projection area of the toner particle.

The average shape factor SF1 is quantified generally by analyzing a microscope image or a scanning electron microscope (SEM) image with an image analyzer, and calculated, for example, as shown below. That is, optical microscope images of toner particles scattered on a surface of a slide glass is inputted through a video camera into a Luzex image analyzer, the maximum lengths and projection areas of 500 toner particles or more are obtained, the SF1 value of each particle is calculated according to the Formula (2), and the average values thereof is assumed to be the average shape factor SF1.

Furthermore, the ratio of the number of toner particles having a SF1 of less than 125 or a SF1 of greater than 135 is the ratio of the number of toner particles within each shape factor range obtained from the SF1 values of 500 particles measured as described above.

On the other hand, recently, other components such as a release agent, other than a binding resin and a coloring agent, are added in the toner in many cases. In addition, various kinds of external additives are also added. Therefore, the composition distribution on a toner surface is very complicated. Accordingly, for example, it is found that measures to avoid uneven distribution of the external additive are insufficient for preventing in-machine contamination and fine unevenness of an image when the toner having a broad shape factor distribution is used.

As the result of the further study by the inventors, it is found that making uniform the charge amounts of individual toner particles by controlling the charge amount of the whole toner is insufficient for obtaining a high quality image that is free from in-machine contamination and image unevenness in addition to background portion fogging, and that surface charges of the toner particles as well have to be made uniform because the charges are likely to vary even among toner surfaces when considering the composition of the materials constituting the toner.

That is, it is difficult to cope with recent demands for higher image quality, only by maintaining a constant average charge amount of the toner, and it is necessary to make uniform the surface charges of the individual toner particles. The inventors found that a surface charge density distribution D of individual toner particles calculated according to Formula (1) below is preferably 5 dB (or about 5 dB) or more.

$$D\ [\text{dB}]=10\times\log(m^2/\sigma^2) \qquad \text{Formula (1):}$$

In the Formula, m represents the average value of surface charge densities of toner particles and σ represents the standard deviation of the surface charge densities of the toner particles.

When the surface charge density distribution D is below 5 dB, in-machine contamination and image unevenness may occur in some cases due to deterioration in the homogeneity of the surface charges of the individual toner particles.

The surface charge density distribution D is desirably 6 dB or more. However, from practical restraints involved in toner production, the upper limit may be approximately 8 dB.

The surface charge density D of the toner was calculated specifically as described below.

First, a developer is left under an environment of a temperature of 22° C. and the relative humidity (RH) of 50% for 170 hrs. Based on the particle diameter d (μm) of one toner particle, its surface area A is calculated by an equation, $A=\pi d^2$ ($\mu m^2$), assuming that the toner particle is spherical. Next, the charge q (fC) of the toner particle is divided by the surface area A to calculate the surface charge density q/A ($fC/\mu m^2$) of the toner particle. The surface charge density is calculated for each of at least 2000 particles, and the average value m and the standard deviation σ thereof are obtained. The surface charge density distribution D is obtained according to the Formula (1).

Since the particle diameter d and the charge q have to be obtained with respect to the same toner particle, an instrument capable of simultaneously measuring the particle diameter and the charge should be used for the measurement. The instrument is not particularly specified as far as it can measure the particle diameter and the charge of one toner particle which are correlated to each other. In the invention, a particle size/charge amount distribution measurement analyzer (trade name: E-SPART ANALYZER, produced by Hosokawa Micron Co., Ltd.) is used for the measurement.

Furthermore, regarding the surface charge density distribution D, not only the chargeability but also the time constant of the charge leakage varies depending on the difference in the compositions between particles and the difference in the compositions between toner surfaces. Accordingly, the homogeneity of the surface charge densities tends to lower when the toner is left to stand, and it is found that this tendency is conspicuous in particular under high temperature and high humidity. The reason for this is considered that, since the moisture absorption amount under high humidity varies depending on the kinds of materials used in the toner such as auxiliary agents, portions having a large amount of adsorbed moisture and portions having a small amount of adsorbed moisture are generated due to the fluctuation of the surface composition of the toner particle and the presence of auxiliary agents of different compositions. It is considered that, as the result, the time constant of the charge leakage is large in the portions having a large amount of adsorbed moisture, while the time constant of the charge leakage becomes small in the portions having a small amount of absorbed moisture; accordingly, the surface charge densities gradually become different between toner particles or between toner surfaces of different compositions.

Accordingly, conditions for obtaining a high quality image free from background portion fogging and in-machine contamination under a high temperature and high humidity environment are slightly different from the above. That is, the surface charge density distribution D expressed by the Formula (1) may be 5 dB or more after the developer is left to stand under an environment of a temperature of 28° C. and a humidity of 85% RH for 170 hrs.

Hereinafter, an electrostatic charge image developer of the invention will be described with reference to an exemplary embodiment.

(Carrier)

The carrier in the exemplary embodiment is a carrier having a resin-coated layer that can be used in a two-component developer and a known carrier may be used without particular restriction as far as the resin used in the resin-coated layer satisfies the characteristics in the scratch strength test. For example, the carrier may be a resin dispersion type carrier where a magnetic powder is dispersed in the matrix resin of the resin-coated layer or a resin impregnation type carrier where a porous core, such as a core material particle having a void, is impregnated and covered with a resin.

Examples of the covering resin/matrix/impregnation resin used in the carrier include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin made of an organosiloxane bond or a modified product thereof, a fluorinated resin, polyester, polycarbonate, a phenolic resin, an epoxy resin, a urea resin, a urethane resin and a melamine resin.

Among these, a resin obtained by polymerizing a monomer containing styrene monomer, such as polystyrene or a styrene-acrylic acid copolymer, may be used in order to satisfy, in particular, the scratch strength characteristics.

The molecular weight and the molecular weight distribution of the resin are obtained under the following conditions, "HLC-81200PC, SC-8020" (trade name, produced by Tosoh Corporation) is used as the GPC. Two columns of "TSKgel, SUPER HM-H" (trade name, produced by Tosoh Corporation, 6.0 mm ID×15 cm) are used, and THF (tetrahydrofuran) is used as an eluting solution. Experimental conditions are set as follows. The sample concentration is 0.5%, the current velocity is 0.6 ml/min, the sample injection amount is 10 μl the measurement temperature is 40° C., and an IR detector is used. Furthermore, a calibration curve is obtained from ten samples of "A-500", "F-1", "F-10", "F-80", "F-380", "A-2500", "F-4", "F-40", "F-128", and "F-700", which are "polystyrene standard reagents TSK STANDARD" (trade name, manufactured by Tosoh Corporation).

The data collection interval in the sample analysis is set to 300 ms.

The glass transition temperature of the resin to be used is preferably from 70° C. (or about 70° C.) to 150° C. (or about 150° C.) and more preferably from 80° C. (or about 80° C.) to 130° C. (or about 130° C.).

Regarding the glass transition temperature (Tg) of the resin or the like, measurement is conducted with a differential scanning calorimeter (trade name: DSC60 with an automatic tangential line processing system, produced by Shimadzu Corporation) in accordance with ASTMD3418-8 under the conditions of a temperature elevation speed of 10° C./min from 25° C. to 150° C. The temperature at an intermediate point in a stepwise endothermic variation is considered to be the glass transition temperature (Tg).

Furthermore, in order to obtain a surface charge density distribution D of 5 dB or more, the carrier as well should have an improved charging efficiency. For that purpose, a resin-coated layer may contain a resin having an alicyclic group. A cycloalkyl group is particularly excellent as the alicyclic group.

The reason why the cycloalkyl group is excellent is not clear. In general, an alkyl group does not adhere strongly to the core material of the carrier, and the cycloalkyl group tends to generate a steric hindrance. Accordingly, it is considered that cycloalkyl groups gather on the surface of the carrier because the cycloalkyl groups tend to be present at positions separated as far as possible from the core material when the resin covers the carrier. It is also considered that, since the cycloalkyl group has high hydrophobicity, excellent charging properties are obtained.

Examples of resins having a cycloalkyl group include (1) a homopolymer of a monomer containing a cycloalkyl group in a side chain, (2) a copolymer obtained by polymerizing at least two kinds of monomers containing a cycloalkyl group in a side chain, and (3) a copolymer of a monomer containing a cycloalkyl group in a side chain and a monomer not containing a cycloalkyl group.

Among resins of (1) to (3), from the viewpoint of obtaining a more conspicuous improvement in charging properties, (2) a copolymer obtained by polymerizing at least two kinds of monomers containing a cycloalkyl group in a side chain is particularly preferred.

As the cycloalkyl group, one having a 3- to 10-membered ring is preferable. Examples thereof include a cyclohexyl group, an adamantyl group, a cyclopropyl group, a cyclobutyl group, a cyclopentyl group, a cyclohexyl group, a cycloheptyl group, a cyclooctyl group, a cyclononyl group, a cyclodecyl group, an isobornyl group, a norbornyl group and a bornyl group. From the viewpoint of less occurrence of uneven distribution in the charge amount, a cyclohexyl group and an adamantyl group are particularly preferred.

Examples of the resin having an alicyclic group include alicyclic group-containing acrylic resins such as cyclopropyl acrylate, cyclopentyl acrylate and cyclohexyl acrylate; norbornene resins; polycarbonate resins; and polyester resins. Cyclohexyl methacrylate is particularly preferred because of its structural stability. Furthermore, a copolymer of the alicyclic group-containing resin and at least one of the following resin components, which are themselves known, may be used: acrylic resins; olefin resins such as polyethylene and polypropylene; polyvinyl based resins and polyvinylidene based resins such as polystyrene, polyvinyl alcohol, polyvinyl butyral, polyvinyl chloride, polyvinyl carbazole, polyvinyl ether and polyvinyl ketone; straight silicone resin made of an organosiloxane bond or modified products thereof; fluorinated resins such as polytetrafluoroethylene, polyfluorinated vinyl, polyfluorinated vinylidene and polychlorotrifluoroethylene; amino resins such as polyurethane, a phenolic resin, a urea-formaldehyde resin, a melamine resin, a benzoguanamine resin, a urea resin and a polyamide resin; and epoxy resin.

In particular, a copolymer including from 0.5% by weight (or about 0.5% by weight) to 5% by weight (or about 5% by weight) of dimethylamino methacrylate is preferable from the viewpoint of imparting charge amount. Furthermore, in order to satisfy the scratch strength characteristics, a resin obtained by copolymerizing a styrene monomer and an alicyclic group-containing resin may be used.

The content of the styrene monomer (styrene composition), the weight average molecular weight of the polymer and the glass transition temperature in this case are the same as those for the resin (not limited to a resin having an alicyclic group) described above.

In general, the carrier may have an appropriate electric resistance value. In order to control the resistance, a conductive powder may be dispersed in the resin. Examples of conductive powders include, but are not limited to, powder of any of the following: metals such as gold, silver and copper, carbon black, titanium oxide, zinc oxide, barium sulfate, aluminum borate, potassium titanate, tin oxide and carbon black.

Examples of the core material of the carrier include magnetic metals such as iron, nickel and cobalt; magnetic oxides such as ferrite and magnetite; and glass beads. When the carrier is used in a magnetic brush method, the core material may be a magnetic material The volume average particle diameter of the core material of the carrier is preferably from 10 μm to 100 μm and more preferably from 25 μm to 50 μm.

When the resin is coated on a surface of the core material of the carrier, a method of coating a coating layer forming solution obtained by dissolving the covering resin and, optionally, various kinds of additives in an appropriate solvent may be adopted. The solvent, without particularly restrictions, may be appropriately selected in consideration of the covering resin, coating aptitude and the like.

As specific resin coating methods, the following methods may be mentioned: a dipping method of dipping powder of the core material of the carrier in the coating layer forming solution, a spray method of spraying the coating layer forming solution is sprayed on a surface of the core material of the carrier, a fluidized-bed method of spraying the coating layer forming solution while the core material of the carrier is floated by a flowing air, and a kneader coater method of mixing the core material of the carrier and the coating layer forming solution in a kneader coater and removing the solvent.

In the exemplary embodiment, the average film thickness of the resin-coated layer is preferably 100 nm (or about 100 nm) or more and more preferably 200 nm (or about 200 nm) or more. When the average film thickness of the resin-coated layer is less than 100 mm in some cases, the external additive having a large particle diameter is not efficiently collected, the electric resistance is reduced due to peeling off of the covering resin layer and the pulverization of the carrier may not be sufficiently controlled in the long term use. The upper limit of the average film thickness of the resin-coated layer is approximately 2 μm.

The average film thickness (μm) of the resin-coated layer is obtained as shown below:

Average film thickness (μm)=[coated resin amount (including all additives such as the conductive agent) per one carrier/surface area per one carrier]÷average specific gravity of the resin-coated layer=$[\frac{4}{3}\pi\cdot(d/2)^2\cdot\rho\cdot Wc]/[4\pi\cdot(d/2)^2]\div\sigma c=(1/6)\cdot(d\cdot\rho\cdot Wc/pc)$ ρ (dimensionless) represents the true specific gravity of the magnetic particles, d (μm) represents a volume average particle diameter of the magnetic particles (core material), ρc represents the average specific gravity of the resin-coated layer, and Wc (parts by weight) represents the total content of the resin-coated layer per 100 parts by weight of the magnetic particles.

In the exemplary embodiment, the volume resistivity of the carrier is controlled preferably in the range of from $1\times10^7$ Ω·cm (or about $1\times10^7$ Ω·cm) to $1\times10^{15}$ Ω·cm (or about $1\times10^{15}$ Ω·cm) and more preferably in the range of from $1\times10^8$ Ω·cm (or about $1\times10^8$ Ω·cm) to $1\times10^{14}$ Ω·cm (or about $1\times10^{14}$ Ω·cm).

When the volume resistivity of the carrier is greater than $1\times10^{15}$ Ω·cm (or greater than about $1\times10^{15}$ Ω·cm), because of high resistance, it is difficult for the carrier to work as a development electrode at the time of development; accordingly, in some cases, deterioration of the solid reproducibility such as occurrence of an edge effect, in particular in a solid image portion, may be caused. On the other hand, when the volume resistivity is less than $1\times10^7$ Ω·cm (or less than about $1\times10^7$ Ω·cm), in some cases, lowered electric resistance may easily causes troubles such as development of the carrier itself due to injection of charges from a developing roll to the carrier when the toner concentration in a developer is lowered.

The volume resistivity of the carrier (Ω·cm) is measured as described below. The measurement environment is set to a temperature of 20° C. and a humidity of 50% RH.

On a surface of a circular jig to which an electrode plate of 20 $cm^2$ is provided, a sample to be measured is placed flat so as to form a layer having a thickness of approximately 1 to 3 mm. Thereon, an electrode plate of 20 $cm^2$ that is similar to the above electrode plate is placed to sandwich the layer. In order to remove a gap between pieces of the sample to be measured, a weight of 4 kg is applied onto the electrode plate placed on the layer, and the thickness (cm) of the layer is measured. Both electrodes above and below the layer are connected to an electrometer and a high voltage generator. A high voltage is applied to both electrodes so that an electric field becomes $10^{3.8}$ V/cm, the current value (A) flowing at that voltage is read, and the volume resistivity (Ω·cm) of the sample is calculated. The Formula for calculating the volume resistivity (Ω·cm) of the sample to be measured is as shown in a Formula (3) below.

$$R=E\times20/(I-I_0)/L \qquad \text{Formula (3):}$$

In the Formula, R represents the volume resistivity (Ω·cm) of the carrier, E represents the applied voltage (V), I represents the current value (A), $I_0$ represents the current value (A) when the applied voltage is 0 V and L represents the thickness (cm) of the carrier layer A factor of 20 expresses an area ($cm^2$) of the electrode plate.

(Toner)

An electrostatic charge image developer of the exemplary embodiment is a so-called two-component developer containing a toner and the carrier. In what follows, the toner will be described with reference to the exemplary embodiment.

The toner used in the exemplary embodiment is not particularly restricted. The toner may be one obtained by adding external additives to toner particles that contain at least a binding resin and a coloring agent.

As the binding resin contained in the toner, known ones that are used in the toner particles may be appropriately selected. Specific examples thereof include homopolymers or copolymers of: styrenes such as styrene and chlorostyrene; monoolefins such as ethylene, propylene, butylene and isoprene; vinyl esters such as vinyl acetate, vinyl propionate, vinyl benzoate, and vinyl lactate; α-methylene aliphatic monocarboxylic acid esters such as methyl acrylate, phenyl acrylate, octyl acrylate, methyl methacrylate, ethyl methacrylate, butyl methacrylate and dodecyl methacrylate; vinyl ethers such as vinyl methyl ether, vinyl ethyl ether, and vinyl butyl ether; and vinyl ketones such as vinyl methyl ketone, vinyl hexyl ketone, vinyl isopropenyl ketone.

Among these, examples of particularly representative binding resins include polystyrene, a styrene-alkyl acrylate copolymer, a styrene-butadiene copolymer, a styrene-maleic anhydride copolymer, polystyrene and polypropylene. Furthermore, polyester, polyurethane, an epoxy resin, a silicone resin, polyamide and modified rosin are also mentioned.

Furthermore, in the exemplary embodiment, a crystalline polyester resin may be contained in the binding resin.

When the crystalline polyester resin is contained, excellent adherence to paper and charging properties at the time of fixation are obtained and the melting point may be controlled in a preferable range. Furthermore, an aliphatic crystalline polyester resin having an appropriate melting point is preferable.

The crystalline polyester resin is synthesized from an acid (dicarboxylic acid) component and an alcohol (diol) component. In what follows, an "acid-derived component" indicates a constituent moiety that was originally an acid component before the synthesis of a polyester resin and an "alcohol-derived component" indicates a constituent moiety that was originally an alcoholic component before the synthesis of the polyester resin.

A "crystalline polyester resin" indicates one that shows not a stepwise endothermic amount variation but a clear endothermic peak in differential scanning calorimetry (DSC). However, a polymer obtained by copolymerizing the crystalline polyester main chain and at least one other component is also called a crystalline polyester if the amount of the other component is 50% by weight or less.

(Acid-Derived Component)

As the acid-derived component, an aliphatic dicarboxylic acid is preferred and straight chain carboxylic acid is particularly preferred. Examples of straight chain carboxylic acids include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,1-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid, and lower alkyl esters and acid anhydrides thereof. Among these, ones having 6 to 10 carbon atoms are preferable from the viewpoints of the crystal melting point and the charging properties. In order to improve the crystallinity, the straight chain carboxylic acid is used preferably in an amount of 95% by mol (or about 95% by mol) or more of the acid component and more preferably 98% by mole (or about 98% by mole) or more of the acid component.

Such other monomers are not particularly restricted, and examples thereof include conventionally known divalent carboxylic acids and dihydric alcohols, for example those described in "Polymer Data Handbook: Basic Edition" (Soc. Polymer Science, Japan Ed.: Baihukan). Specific examples of the monomer components include, as divalent carboxylic acids, dibasic acids such as phthalic acid, isophthalic acid, terephthalic acid, naphthalene-2,6-dicarboxylic acid, naphthalene-2,7-dicarboxylic acid, and cyclohexanedicarboxylic acid, and anhydrides and lower alkyl esters thereof. Only one of these acids may be used, or alternatively, two or more of these acids may be used in combination.

As the acid-derived components, other than the aliphatic dicarboxylic acid-derived components, a component such as a dicarboxylic acid-derived component having a sulfonic acid group may be contained.

The dicarboxylic acid having a sulfonic acid group is effective from the viewpoint of achieve excellent dispersion state of a coloring agent such as a pigment. Furthermore, when a whole resin is emulsified or suspended in water to prepare a toner mother particle, a sulfonic acid group, as will be described below, enables the resin to be emulsified or suspended without a surfactant. Examples of such dicarboxylic acids having a sulfonic group include, but are not limited to, sodium 2-sulfoterephthalate, sodium 5-sulfoisophthalate and sodium sulfosuccinate. Furthermore, lower alkyl esters and acid anhydrides of such dicarboxylic acids having a sulfonic group, for example, are also usable. Among these, sodium 5-sulfoisophthalate and the like are preferable in view of the cost. The content of the dicarboxylic acid having a sulfonic acid group is preferably from 0.1% by mole to 2.0% by mole and more preferably from 0.2% by mole to 1.0% by mole. When the content is more than 2% by mole, the charging properties is deteriorated. Here, "component mol %" indicates the percentage when the total amount of each of the components (acid-derived component and alcohol-derived component) in the polyester resin is assumed to be 1 unit (mole).

(Alcohol-Derived Component)

As alcohol components, aliphatic dialcohols may be used. Examples thereof include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-dodecanediol, 1,12-undecanediol, 1,13-tridecanediol, 1,14-tetradecanediol, 1,18-octadecanediol and 1,20-eicosanediol. Among them, those having 6 to 10 carbon atoms are preferable in view of the crystal melting points and charging properties. In order to raise crystallinity, it is preferable to use the straight chain dialcohols in an amount of 95% by mole (or about 95% by mole) or more of the alcohol component, and is more preferable to use the straight chain dialcohols in an amount of 98% by mole (or about 98% by mole) or more.

Examples of other dihydric dialcohols include bisphenol A, hydrogenated bisphenol A, bisphenol A ethylene oxide adduct, bisphenol A propylene oxide adduct, 1,4-cyclohexanediol, 1,4-cyclohexanedimethanol, diethylene glycol, propylene glycol, dipropylene glycol, 1,3-butanediol and neopentyl glycol. Only one of these dihydric dialcohols may be used, or two or more of these dihydric dialcohols may be used in combination.

Furthermore, as needs arise, for the purpose of adjusting the acid number and hydroxyl number, the following may be used: monovalent acids such as acetic acid and benzoic acid; monohydric alcohols such as cyclohexanol and benzyl alcohol; benzenetricarboxylic acid, naphthalenetricarboxylic acid, and anhydrides and lower alkylesters thereof; trivalent alcohols such as glycerin, trimethylolethane, trimethylolpropane and pentaerythritol.

The crystalline polyester resins may be synthesized from an arbitrary combination of components selected from the above-mentioned monomer components, by using a conventional known method described in, for example, Polycondensation (the Kagakudoj in), Polymer Experimental Study (polycondensation and polyaddition: KYORITSU SHUPPAN CO., LTD) and Polyester Resin Handbook (edited by Nikkan Kogyo Shimbun, Ltd.). The ester exchange method and the direct polycondensation method may be used singularly or in a combination thereof. The molar ratio (acid component/alcohol component) when the acid component and alcohol component are reacted varies depending on the reaction conditions and cannot be generally decided. The molar ratio is usually about 1/1 in direct polycondensation. In the ester exchange method, a monomer such as ethylene glycol, neopentyl glycol or cyclohexanedimethanol, which may be distilled away under vacuum, is often used in excess.

The production of the polyester resin is usually carried out at a polymerization temperature of from 180° C. to 250° C., and, as needs arise, the pressure within the reaction system is reduced and the reaction is carried out while removing the water and alcohol generated in the condensation reaction. When a monomer is not dissolved or incompatible under the reaction temperature, a solvent with a high boiling point may be added as an auxiliary solubilizing agent to dissolve the monomer. The polycondensation reaction is carried out while the auxiliary solubilizing agent is distilled away. When a monomer having a poor compatibility exists in the copolymerization reaction, the monomer having a poor compatibility may be previously condensed with an acid or alcohol that is to be polycondensed with the monomer, and then a polycondensation reaction with the main component may be carried out.

Examples of catalysts that may be used in the production of the crystalline polyester resin include compounds of alkali metals such as sodium and lithium, compounds of alkaline earth metals such as magnesium and calcium, compounds of metals such as zinc, manganese, antimony, titanium, tin, zirconium and germanium, phosphite compounds, phosphate compounds and amine compounds. Specific examples thereof include sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenyl antimony, tributyl antimony, tin formate, tin oxalate, tetraphenyltin, dibutyltin dichloride, dibutyltin oxide, diphenyltin oxide, zirconium tetrabutoxide, zirconium naphthenate, zirconyl carbonate, zirconyl acetate, zirconyl stearate, zirconyl octylate, germanium oxide, triphenyl phosphate, tris(2,4-di-t-butylphenyl)phosphite, ethyltriphenyl phosphonium bromide, triethylamine and triphenylamine. Among these compounds, tin based catalysts and titanium based catalysts are preferable in view of the charging properties, and, among these, dibutyltin oxide is preferably used.

The melting point of the crystalline polyester resin used in the exemplary embodiment is preferably from 50° C. to 120° C., and more preferably from 60° C. to 110° C. When the melting point is less than 50° C., the storage stability of the toner and the storage stability of the toner image after fixing may be problematic in some cases. Furthermore, when the melting point is higher than 120° C., sufficient low temperature fixing may not be obtained in comparison with conventional toners in some cases.

For the measurement of the melting point of the crystalline polyester resin, a differential scanning calorimeter (DSC) is used. When a measurement is carried out at a temperature elevation speed of 10° C./min from room temperature to 150° C., the melting point is obtained as a melting peak temperature in input compensation differential scanning calorimetry shown in JIS K-7121, which is incorporated herein by reference. The crystalline resin has plural melting peaks in some cases. In the invention, the maximum peak is taken as the melting point.

In the exemplary embodiment, the content of the crystalline polyester resin in the toner is preferably from 3% by weight (or about 3% by weight) to 20% by weight (or about 20% by weight) and more preferably from 5% by weight (or about 5% by weight) to 15% by weight (or about 15% by weight). When the content is set in the range, the fixing temperature may be effectively lowered and charge retention after charging may be excellent.

A coloring agent contained in the toner is not particularly restricted. Examples thereof include magnetic powders such as magnetite and ferrite, carbon black, aniline blue, Chalcoyl Blue, Chrome Yellow, Ultramarine Blue, DuPont Oil Red, Quinoline Yellow, Methylene Blue Chloride, Phthalocyanine Blue, Malachite Green Oxalate, lamp black, Rose Bengal, C.I. Pigment Red 48:1, C.I. Pigment Red 122, C.I. Pigment Red 57:1, C.I. Pigment Yellow 97, C.I. Pigment Yellow 12, C.I. Pigment Blue 15:1 and C.I. Pigment Blue 15:3.

Furthermore, a release agent and/or a charge controller may be added to the toner of the exemplary embodiment, as necessary.

Typical examples of the release agents include low molecular weight polyethylene, low molecular weight polypropylene, Fischer-Tropsch wax, montan wax, carnauba wax, rice wax and candelilla wax.

As the charge controller, known ones may be used. Examples thereof include azo based metal complex compounds, metal complex compounds of salicylic acid, and resin type charge controllers having a polar group. When the toner is produced by a wet method described below, it is preferable to use a material that is scarcely soluble in water from the viewpoints of controlling the ionic strength and reducing contamination of wastewater.

When toner mother particles are produced, for example, any of the following methods may be used: a kneading and pulverizing method in which a binding resin, a coloring agent and, optionally, a release agent, a charge controller, and the like are kneaded, pulverized and classified; a method in which the shape of the particles obtained by the kneading and pulverizing method are changed by a mechanical impact or thermal energy; an emulsion polymerization aggregation method in which a dispersion liquid obtained by emulsion polymerizing a polymerizable monomer for forming a binding resin and a dispersion liquid of a coloring agent and, optionally, a release agent, a charge controller, and the like are blended, aggregated, heated and fused to obtain toner particles; a suspension polymerization method in which a polymerizable monomer for forming a binding resin and a solution of a coloring agent, and, optionally, a release agent, a charge controller, and the like are suspended in an aqueous solvent and polymerized; and a dissolution suspension method in which a binding resin and a solution of a coloring agent, and, optionally, a release agent, a charge controller, and the like are suspended in an aqueous solvent and granulated. Furthermore, a production method may be conducted in which aggregated particles are adhered onto the toner mother particle obtained above as a core, and fused by heating to form a core-shell structure.

The volume average particle diameter of thus produced toner mother particles is preferably in the range of from 2 μm to 8 μm and more preferably in the range of from 3 μm to 7 μm. When the volume average particle diameter is less than 2 μm, in some cases, the fluidity of the toner is deteriorated and, since charging properties imparted by the carrier is likely to be insufficient, fog in the background portion is caused and density reproducibility tends to be deteriorated. On the other hand, when the volume average particle diameter is greater than 8 μm, gradation characteristics and granularity are smaller, a high quality image is hard to obtain in some cases since improvements in reproducibility of fine dots are small.

As a countermeasure from the toner side to make the surface charge density distribution D of the toner 5 dB or more, the particle size distribution may be made as narrow as possible. For this reason, as an index of a particle size distribution of the toner, the volume average particle size distribution index GSDv is preferably 1.30 (or about 1.30) or less and more preferably 1.25 (or about 1.25) or less. Furthermore, GSDv/GSDp, which is a ratio of GSDv to the number average particle size distribution index GSDp, is preferably 0.95 or more, and more preferably 0.98 or more.

Values of the volume average particle size and the particle size distribution index are measured and calculated as described below. First, on the basis of the particle size distribution of the toner measured by using Coulter Multi-Sizer II (trade name, produced by Beckmann Coulter Co., Ltd.), volumes and numbers in particle size ranges (channels) are plotted in respective cumulative distributions, accumulating from the small diameter side. Particle diameters for accumulations of 16% are defined as a cumulative volume average particle diameter $D_{16V}$ and a cumulative number average particle diameter $D_{16P}$, particle diameters for accumulations of 50% are defined as a cumulative volume average particle diameter $D_{50V}$ (this value is considered to be a volume average particle diameter) and a cumulative number average particle diameter $D_{50P}$, and particle diameters for accumulations of 84% are defined as a cumulative volume average particle diameter $D_{84V}$ and a cumulative number average particle diameter $D_{84P}$.

Using these, a volume average particle diameter distribution index ($GSD_V$) is calculated as $(D_{84V}/D_{16V})^{1/2}$, and a number average particle diameter distribution index (GSDp) is calculated as $(D_{84P}/D_{16P})^{1/2}$.

As a measurement method, 0.5 to 50 mg of a measurement sample is added in 2 ml of an aqueous solution containing 5% by weight of a surfactant (which may be sodium alkylbenzene sulfonate) as a dispersing agent, and the solution is added to 100 to 150 ml of the electrolytic solution. The electrolytic solution in which the measurement sample is suspended is subjected to a dispersing treatment for about 1 min by using an ultrasonic dispersing unit, and a particle size distribution is measured in the particle size range from 2.0 to 40 μm by using the Coulter Multi-Sizer II with an aperture having an aperture diameter of 100 μm. The number of particles to be measured is 50,000.

As mentioned above, the average shape factor SF1 of the toner used in the exemplary embodiment is from 125 to 135. However, spherical toner particles having a relatively small shape factor and amorphous toner particles having a relatively large shape factor are contained at certain ratios, so that the toner as a whole has a configuration having a somewhat broad shape factor distribution.

In order to obtain a toner having the configuration, a method of mixing toners having different shapes may be used. Specifically, a method in which plural toners having a slightly different average shape factor SF1 are mixed and a method in which slight amounts of more spherical toner particles and amorphous toner particles are added to the toner having an average shape factor SF1 in the above-mentioned range, may be cited.

Furthermore, when an emulsion aggregation method is used as a production method of toner mother particles, a toner having the configuration may be obtained also by a method in which at least one of pH or temperature is controlled step-by-step at coalescence in a heating and fusing step. Specifically, the shape of the toner tends to be determined by the pH at coalescence. Particles having smaller particle sizes tend to be made spherical by an influence of the temperature and particles having larger particle sizes tend to be made spherical by an influence of the pH. In the method, for example, the pH is maintained low at a relatively low coalescence temperature so as to control the shape of particles having larger particle diameters, and then the temperature is elevated while maintaining a high pH so as to control the shape of particles having smaller particle diameters.

In the exemplary embodiment, in order to improve the transfer efficiency, fluidity, cleaning efficiency and controllability of charge amount and particularly the fluidity, an external additive is contained in the toner. The external additive means inorganic particles to be adhered onto surfaces of the toner mother particles.

The external additive to be added to the toner is not particularly defined. However, at least one kind of external additive may be an inorganic oxide compound that serves to control the powder fluidity and the charging properties and has a small particle diameter of from 7 nm to 40 nm in terms of a volume average primary particle diameter Examples of the inorganic oxide having a small particle diameter include silica, alumina, oxide of titanium (titanium oxide, meta-titanate), calcium carbonate, magnesium carbonate, calcium phosphate and carbon black.

In particular, it is preferable to use a titanium oxide having a volume average primary particle diameter of from 15 nm to 40 nm from the viewpoint of obtaining, without adversely affecting on the transparency, excellent charging properties, environmental stability, fluidity, caking resistance, stable negative charging properties and image quality maintenance.

Furthermore, the inorganic oxide particles acquires higher dispersibility and their effects on increasing powder fluidity are enhanced when subjected to a surface treatment. In the surface treatment, known substances may be used. Specific examples thereof include methyl trichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltrimethoxysilane, decyltrimethoxysilane, hexamethyldisilazane, N,O-(bistrimethylsilyl)acetamide, N,N-bis(trimethylsilyl)urea, tert-butyldimethyl chlorosilane, vinyltrichlorosilane, vinyltrimethoxysilane, vinyltriethoxysilane, γ-methacryloxypropyl trimethoxysilane, β-(3,4-epoxycyclohexyl)ethyltrimethoxy silane, γ-glycidoxypropyltrimethoxy silane, γ-glycidoxypropylmethyl diethoxysilane, γ-mercaptopropyl trimethoxysilane and γ-chloropropyl trimethoxysilane.

An addition amount of the inorganic oxide having a small particle diameter may be in the range of from 0.5 parts by weight to 2.0 parts by weight with respect to 100 parts by weight of the toner mother particles.

Furthermore, metal oxide particles having a large particle diameter such as 70 nm (or about 70 μm) or more in terms of volume average primary particle diameter may be added to the toner in place of, or simultaneously with, the external additive having a small particle diameter. This is because use of the metal oxide particles having a large particle diameter is preferable from the viewpoint of securing transfer efficiency.

The volume average primary particle diameter of the metal oxide particles having a large particle diameter is preferably from 70 nm (or about 70 nm) to 300 nm (or about 300 μm), and more preferably from 80 nm (or about 80 nm) to 200 nm (or about 200 nm) in terms of volume average primary particle diameter.

Examples of the metal oxide particles having a large particle diameter include silica, titanium oxide, meta-titanate, aluminum oxide, magnesium oxide, alumina, barium titanate, magnesium titanate, calcium titanate, strontium titanate, zinc oxide, chromium oxide, antimony trioxide, magnesium oxide and zirconium oxide. Among these, from the viewpoint of precisely controlling the charging properties, it is preferable to use at least one selected from silica, titanium oxide and meta-titanate.

Particularly in an image such as a full-color image where high transfer efficiency is demanded, the silica is preferably a monodispersed spherical silica having a volume average primary particle diameter of 70 nm or more, and the volume average primary particle diameter is more preferably from 80 nm to 200 nm.

When the average particle diameter of the monodispersed spherical silica is less than 70 nm, the silica may not be effective for reducing non-electrostatic adherence between the toner and the photoreceptor. In particular, the monodispersed spherical silica tends to be buried in the toner mother particles due to the stress inside of the developing unit, so that its effects on the improvement in the developability and transfer efficiency are likely to be reduced remarkably. On the other hand, when the average particle diameter of the monodispersed spherical silica is greater than 300 nm, the silica tends to separate from the toner mother particles and does not work effectively to reduce the non-electrostatic adherence; moreover, the silica tends to move to a contact member, and is likely to cause secondary defects such as inhibition against charging and image quality defect.

The monodispersed spherical silica is monodispersed and spherical. Accordingly, the monodispersed spherical silica may be uniformly dispersed on a surface of the toner mother particle, and may provide a stable spacer effect. The definition of the monodispersity can be expressed by a standard deviation relative to an average particle diameter, including the case of aggregates. The standard deviation of the particle sizes is preferably the volume average particle diameter D50×0.22 (or about D50×0.22) or less. Furthermore, the Wadell's sphericity may be used to discuss the definition of the sphericity. The sphericity is preferably 0.6 (or about 0.6) or more and more preferably 0.8 (or about 0.8) or more.

The Wadell's sphericity is obtained from the Formula shown below.

Sphericity=(the surface area of a sphere having the same volume as that of an actual particle)/(the surface area of the actual particle)

In the Formula, the numerator, i.e. "(the surface area of a sphere having the same volume as that of an actual particle)" is obtained by calculation from an average particle diameter. Furthermore, a BET specific surface area obtained by using a powder specific surface area measurement instrument SS-100 (trade name, produced by Shimadzu Corporation) is as the denominator, i.e. "(a surface area of an actual particle)".

The addition amount of the metal oxide particles having a large particle diameter is preferably from 0.5 parts by weight to 5.0 parts by weight and more preferably from 1.0 parts by weight to 3.0 parts by weight with respect to 100 parts by weight of the toner mother particles.

Lubricant particles may also be used, and examples of the lubricant particles include solid-state lubricants such as graphite, molybdenum disulfide, talc, fatty acid, higher alcohol aliphatic alcohol and metal salt of fatty acid; low molecular weight polyolefins such as polypropylene, polyethylene and polybutene; silicones having a softening point upon heating; aliphatic amides such as oleic acid amide, erucic acid amide, ricinoleic acid amide, and stearic acid amide; waxes of vegetable origins such as carnauba wax, rice wax, candelilla wax, Japan wax and jojoba oil; animal waxes such as bees wax; mineral and petroleum waxes such as montan wax, ozokerite, ceresin, paraffin wax, microcrystalline wax and Fischer-Tropsch wax; and modified products thereof. The average shape factor SF1 of the lubricant particles is preferably 140 or more from the viewpoint of obtaining cleanability.

Furthermore, a known inorganic oxide may also be used as a polishing agent. Examples thereof include cerium oxide, strontium titanate, magnesium oxide, alumina, silicon carbide, zinc oxide, silica, titanium oxide, boron nitride, calcium pyrophosphate, zirconia, barium titanate, calcium titanate, and calcium carbonate. In addition, composite materials thereof may be used.

The toner particles used in the exemplary embodiment may be produced by blending the toner mother particles and the external additive by using a Henschel mixer, a V-blender, or the like. Furthermore, when the toner mother particles are produced according to a wet process, the particles may be added in a wet manner.

The mixing ratio (by weight ratio) of the toner to the carrier in a developer of the exemplary embodiment may be approximately in the range of toner: carrier=1:100 to 30:100 and more preferably approximately in the range of 3:100 to 20:100.

(Image Forming Apparatus)

In the next place, an image forming apparatus of the invention, which uses the developer of the invention, will be described.

An image forming apparatus of the invention includes: an image holding member; a developing unit for developing an electrostatic charge image formed on the image holding member as a toner image by using a developer; a transferring unit for transferring the toner image formed on the image holding member onto a transfer receiver; and a fixing unit for fixing the transferred toner image on the transfer receiver, and the electrostatic charge image developer of the invention is used as the developer.

In the image forming apparatus, for example, a portion containing the developing unit may have a cartridge structure (process cartridge) that is attachable to and detachable from an image forming apparatus main body. As the process cartridge, a process cartridge according to the invention that has at least a developer holder and accommodates the electrostatic charge image developer of the invention may be used preferably.

In what follows, an example of the image forming apparatus of the invention will be described. However, the invention is not restricted thereto. Main parts shown in the drawings will be described, but descriptions on other parts are omitted.

FIG. 1 is a schematic configurational diagram showing a quadruple tandem type full-color image forming apparatus. The image forming apparatus shown in FIG. 1 includes first to fourth electrophotographic image forming units 10Y, 10M, 10C and 10K (image forming units) of an electrophotographic method that outputs images of the respective colors of yellow (Y), magenta (M), cyan (C) and black (K) based on color-separated image data. The image forming units (hereinafter, simply referred to as "units") 10Y, 10M, 10C and 10K are disposed in parallel in a horizontal direction at a predetermined distance from each other. The units 10Y, 10M, 10C and 10K may be process cartridges that are attachable to and detachable from the image forming apparatus main body.

In an upper side in the drawing of the respective units 10Y, 10M, 10C and 10K, an intermediate transfer belt 20 as an intermediate transfer body is disposed to extend through the respective units. The intermediate transfer belt 20 is wound around a driving roller 22 and a support roller 24 which is in contact with the inner surface of the intermediate transfer belt 20. The driving roller 22 and the support roller 24 are disposed from right to left in the drawing, and are separated from each other. The intermediate transfer belt 20 runs in the direction of from the first unit 10Y to the fourth unit 10K. The support roller 24 is pressed in the direction departing from the driving roller 22 by a spring or the like (not shown in the drawing) to provide a certain tension to the intermediate transfer belt 20 wound around the both rollers. On the image holding member side surface of the intermediate transfer belt 20, an intermediate transfer body cleaning unit 30 is disposed to oppose the driving roller 22.

Furthermore, toners of four colors of yellow, magenta, cyan and black, which are stored in toner cartridges 8Y, 8M, 8C and 8K, may be supplied to developing units (developing parts) 4Y, 4M, 4C and 4K of the respective units 10Y, 10M, 10C and 10K.

The aforementioned first to fourth units 10Y 10M, 10C and 10K have equivalent configurations. Accordingly, the first unit 10Y that forms a yellow image, which is disposed on the upstream side in the running direction of the intermediate transfer belt, will be described as a representative thereof. In portions equivalent to that of the first unit 10Y, reference marks provided with magenta (M), cyan (C) and black (K) are imparted in place of yellow (Y), and descriptions of the second to fourth units 10M, 10C and 10K are omitted.

The first unit 10Y has a photoreceptor 1Y that works as an image holding member. Around the photoreceptor 1Y, a charging roller 2Y that charges the surface of the photoreceptor 1Y to a predetermined potential; an exposure unit 3 that exposes the charged surface by a laser ray beam 3Y based on color-separated image signals to form an electrostatic charge image; a developing unit (developing part) 4Y that supplies a charged toner to the electrostatic charge image to develop the electrostatic charge image; a primary transfer roller 5Y (primary transfer part) that transfers the developed toner image onto the intermediate transfer belt 20; and a photoreceptor cleaning unit (cleaning part) 6Y having a cleaning blade that removes toner remaining on the surface of the photoreceptor 1Y after the primary transfer, are sequentially disposed.

The primary transfer roller 5Y is disposed at the inner side of the intermediate transfer belt 20, at a position that opposes the photoreceptor 1Y. Furthermore, bias power sources (not shown in the drawing) that apply primary transfer biases are connected to the respective primary transfer rollers 5Y, 5M, 5C and 5K. Each bias power source changes the transfer bias applied to the corresponding primary transfer roller by a controller (not shown).

In what follows, an operation by which a yellow image is formed in the first unit 10Y will be described. Prior to the operation, a surface of a photoreceptor 1Y is charged to a potential of substantially −600 V to −800 V by using a charging roller 2Y.

The photoreceptor 1Y is formed by laminating a photosensitive layer on a conductive base material (having a volume resistivity at 20° C. of $1\times10^{-6}$ Ωcm or less). The photosensitive layer is usually in a high resistance state (substantially same as the resistance of a usual resin), but has a property of changing the specific resistance of a portion irradiated with a laser beam (laser beam 3Y). The laser beam 3Y is output through an exposing unit 3 onto a surface of the charged photoreceptor 1Y, in accordance with yellow image data transmitted from a controller (not shown). The laser beam 3Y is irradiated on the photosensitive layer on the surface of the photoreceptor 1Y, whereby an electrostatic charge image of a yellow printing pattern is formed on the surface of the photoreceptor 1Y.

The electrostatic charge image is an image formed by charging on the surface of the photoreceptor 1Y and is a so-called negative latent image formed by the following manner: the specific resistance of the irradiated portion of the photosensitive layer is lowered by the laser beam 3Y to allow electric charges on the surface of the photoreceptor 1Y to flow out, while electric charges of a portion that is not irradiated by the laser beam 3Y remain.

The electrostatic charge image formed thus on the photoreceptor 1Y is conveyed to a predetermined developing position owing to the rotation of the photoreceptor 1Y. Then, the electrostatic charge image on the photoreceptor 1Y is visualized (developed) by a developing unit 4Y at the developing position.

A yellow toner that contains at least a yellow coloring agent, a crystalline resin and an amorphous resin and has a volume average particle diameter of 7 μm is stored in the developing unit 4Y. The yellow toner is tribocharged by being agitated inside of the developing unit 4Y, and the yellow toner having an electric charge of the same polarity (negative polarity) as that of electric charges provided by charging on the photoreceptor 1Y is retained on a developer roll (developer holder). Then, when the surface of the photoreceptor 1Y goes past the developing unit 4Y, the yellow toner is electrostatically adhered to a neutralized latent image portion on a surface of the photoreceptor 1Y and develops the latent image. The photoreceptor 1Y on which the yellow toner image is formed is run at a predetermined speed and thereby the developed toner image on the photoreceptor 1Y is conveyed to a predetermined primary transfer position.

When the yellow toner image on the photoreceptor 1Y is conveyed to the primary transfer position, a predetermined primary transfer bias is applied to a primary transfer roller 5Y and thereby an electrostatic force directing from the photoreceptor 1Y to the primary transfer roller 5Y works on the toner image and the toner image on the photoreceptor 1Y is transferred onto an intermediate transfer belt 20. The transfer bias applied at this time is of (+) polarity, which is opposite to the polarity (−) of the toner. For example, the first unit 10Y is controlled to approximately +10 μA by a controller (not shown in the drawing).

On the other hand, the residual toner remaining on the photoreceptor 1Y is removed and recovered by a cleaning unit 6Y.

Furthermore, primary transfer biases applied to the primary transfer rollers 5M, 5C and 5K located downstream the first unit 10Y as well are controlled similarly to the first unit.

Thus, an intermediate transfer belt 20 on which the yellow toner image was transferred in the first unit 10Y is conveyed sequentially through the second to fourth units 10M, 10C and 10K, and thereby toner images of the respective colors are transferred and superposed to achieve multiple transfer.

The intermediate transfer belt 20 on which toner images of four colors are multiple-transferred through the first to fourth units reaches a secondary transfer portion that is constituted of the intermediate transfer belt 20, a support roller 24 in contact with the inner surface of the intermediate transfer belt 20 and a secondary transfer roller (secondary transfer unit) 26 disposed at the image holding surface side of the intermediate transfer belt 20. On the other hand, a recording paper (transfer receiver) P is fed at a predetermined timing through a feeding unit to a gap between the secondary transfer roller 26 and the intermediate transfer belt 20 which are in pressure contact, and a predetermined secondary transfer bias is applied to the support roller 24. The transfer bias applied at this time has a (−) polarity, which is the same polarity as the polarity (−) of the toner, and thereby an electrostatic force directing from the intermediate transfer belt 20 to the recording paper P is exerted on the toner image to transfer the toner image on the intermediate transfer belt 20 onto the recording paper P. The secondary transfer bias at this time is determined depending on the resistance detected by a resistance detecting unit (not shown in the drawing) that detects the resistance of the secondary transfer portion, and is controlled by a voltage.

The color-superposed toner image is melted and fixed on the recording paper P when the recording paper P is delivered to a fixing unit (fixing part) 28 to heat the toner image. The recording paper P where a color image has been fixed is conveyed to an exit portion and thereby a series of color image forming operations comes to completion.

In the exemplified image forming apparatus, the toner image is transferred onto the recording paper P through the intermediate transfer belt 20. However, the image forming apparatus is not limited to this configuration, and may have a structure in which a toner image is directly transferred from the photoreceptor to the recording paper.

(Process Cartridge)

Figure 2:
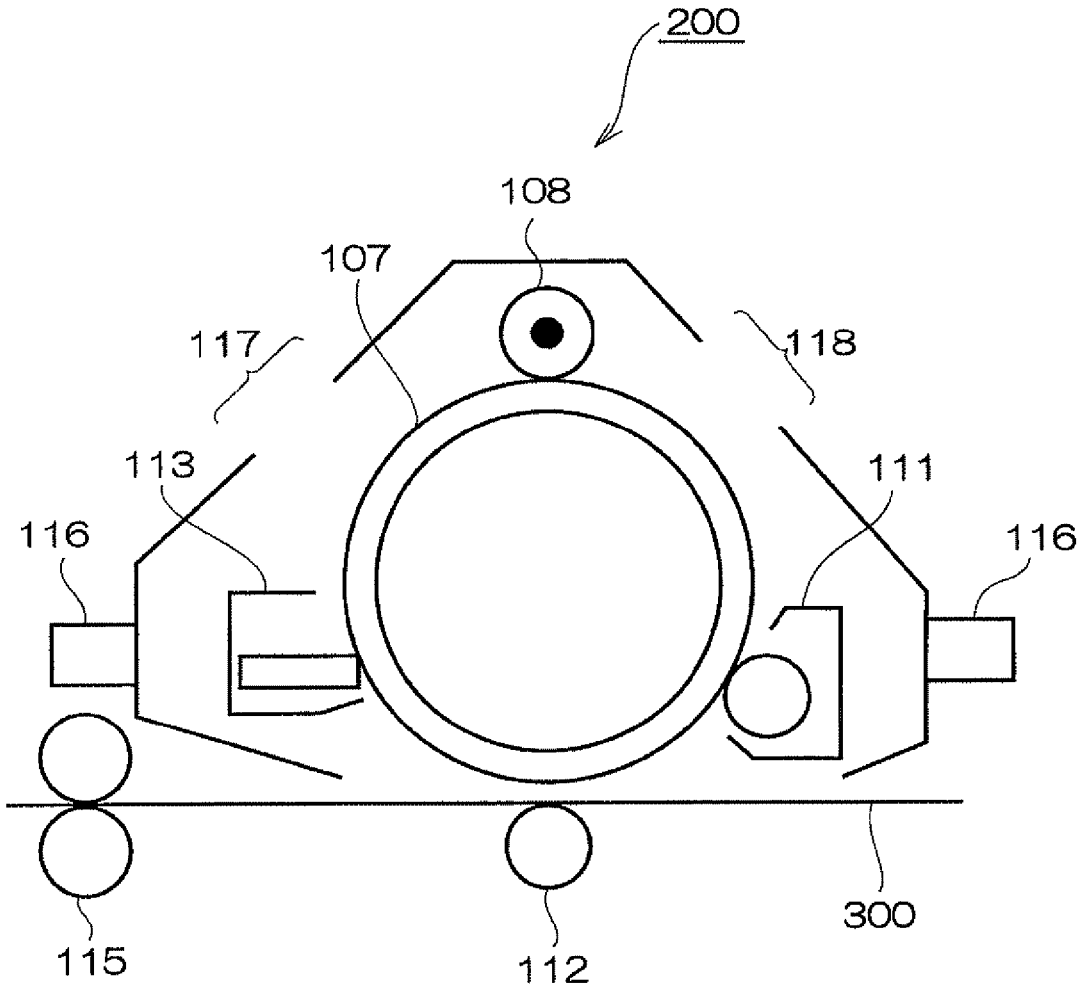
FIG. 2 is a schematic configurational diagram showing an example of a process cartridge of the invention.

FIG. 2 is a schematic configurational diagram showing one example of a process cartridge that stores an electrostatic charge image developer of the invention. A process cartridge 200 is formed by combining and integrating, by using an attaching rail 116, a photoreceptor 107, a charging roller 108, a developing unit 111, a photoreceptor cleaning unit (cleaning part) 113 provided with a cleaning blade, an opening 118 for exposure and an opening 117 for discharging exposure.

The process cartridge 200 is configured to be attachable to and detachable from an image forming apparatus main body that includes a transfer unit 112, a fixing unit 115 and other constituent portion(s) (not shown), and constitutes an image forming apparatus together with the image forming apparatus main body. Reference numeral 300 represents recording paper.

The process cartridge shown in FIG. 2 includes a charging unit 108, a developing unit 111, a cleaning unit (cleaning part) 113, an opening 118 for exposure and an opening 117 for discharging exposure. However, these units may be selectively combined. The process cartridge of the invention includes, other than the photoreceptor 107, at least one selected from the group consisting of a charging unit 108, a developing unit 111, a cleaning unit (cleaning part) 113, an opening 118 for exposure and an opening 117 for discharging exposure.

EXAMPLES

In what follows, the invention will be described with reference to examples. However, the invention is not restricted to the examples. In the examples below, "part" and mean "parts by weight" and "% by weight", respectively, unless mentioned otherwise.

(Measurement Methods of Various Kinds of Characteristics)

In the beginning, measurement methods of physical properties (excluding already-described methods) of toners used in Examples and Comparative Examples will be described.

(Volume Average Particle Diameter of Resin Particles, Coloring Agent Particles and the Like)

Volume average particle diameters of resin particles, particles of coloring agents, and the like are measured by using a laser diffraction particle size distribution measurement analyzer (trade name: LA-700, produced by Horiba Ltd.,).

(Glass Transition Temperature and Melting Temperature of Resin)

The glass transition temperature (Tg) of the binding resin or the like is obtained by measurement with a differential scanning calorimeter (trade name: DSC60 with an automatic tangential processing system, produced by Shimadzu Corporation) in accordance with ASTMD3418-8 under the conditions of a temperature elevation speed of 10° C./min from 25° C. to 150° C. The temperature of the intermediate point in a stepwise endothermic variation is assumed to be the glass transition temperature, and the peak temperature of the endothermic peak is assumed to be the melting temperature.

(Volume Average Primary Particle Diameter of External Additive)

A laser diffraction scattering type particle size distribution measurement analyzer (trade name: Master Sizer 2000, produced by Malvern) is used for measurement.

A sample in a state of dispersion liquid is adjusted so as to have a solid content of about 2 g, and ion exchanged water is added thereto to increase the volume to about 40 ml. This is added into a cell until the concentration becomes appropriate. After waiting for about 2 min during which the concentration in the cell becomes substantially stabilized, measurement is conducted. Obtained volume particle size distributions for individual channels are cumulated from the smaller side in the particle diameter, and a particle diameter at which a cumulated value becomes 50% is taken as the volume average particle size, and this is taken as the volume average primary particle diameter of the particles of the external additive.

When the respective particles such as particles of the external additive are measured, 2 g of a measurement sample is added into 50 ml of an aqueous solution of a surfactant, for example, 5% aqueous solution of sodium alkylbenzene sulfonate, followed by dispersing for 2 min with a ultrasonic dispersing device (1000 Hz) to prepare a sample, further followed by measuring by a method similar to that used for the above-described dispersion liquid.

(Surface Charge Density Distribution of Toner)

In order to obtain a surface charge density distribution D from the Formula (1), a developer on a surface of a sleeve (developer holder) of a developing unit left in an environment of 22° C. and 50% RH for 170 hrs is sampled by about 0.3 to about 0.7 g, and the particle diameter and the electric charge for every toner particles are measured simultaneously by using a particle size/charge amount distribution measurement analyzer (E-SPART ANALYZER, produced by Hosokawa Micron Co., Ltd.).

Regarding the specific measurement conditions, firstly, the analyzer is left in an environment of 22° C.±3° C. and 50% RH±10% RH for 24 hrs or more to condition the temperature and humidity before measurement. After it is confirmed that the analyzer is sufficiently conditioned in the temperature and humidity, a part of the sampled developer is held by a magnet, and disposed in the vicinity of a suction port of the analyzer, and only the toner in the developer is blown off by a nitrogen gas. The toner thus separated from the carrier is suctioned by the suction port and an electric charge and a particle diameter are measured. An average value m and a standard deviation σ are obtained by repeating the operation until 2000 particles of the toner are counted. The respective data are output and a surface charge density distribution D is calculated from the Formula (1).

The surface charge density distribution after being left under a high temperature and high humidity environment is measured as follows. An image forming apparatus described below is left for 24 hrs or more in a thermostat or an environmental chamber conditioned to 28° C. and 85% RH. After it is confirmed that the apparatus is sufficiently conditioned in the temperature and humidity, 20 sheets are printed, and about 3 to about 10 g of the developer on a sleeve surface of the developing unit is sampled in a manner similar to the above. Then, the developer if left as it is in the environment for 170 hrs, and the particle size and the charge amount are measured in the same manner to obtain a surface charge density distribution D.

(Preparation of Toner)

(Preparation of Dispersion Liquid of Amorphous Polyester Resin)

Ethylene glycol (produced by Wako Pure Chemical Industries, Ltd.): 37 parts

Neopentyl glycol (produced by Wako Pure Chemical Industries, Ltd.): 65 parts 1,9-nonanediol (produced by Wako Pure Chemical Industries, Ltd.): 32 parts Terephthalic acid (produced by Wako Pure Chemical Industries, Ltd.): 96 parts The monomers are charged in a flask, heated up to 200° C. over 1 hr and 1.2 parts of dibutyl tin oxide is charged after the inside of a reaction system is confirmed to be uniformly agitated. Furthermore, the temperature is elevated over 6 hrs from 200° C. up to 240° C. while distilling away the generated water, a dehydration condensation reaction is further continued for 4 hrs at 240° C., thereby, an amorphous polyester resin having an acid value of 9.4 mg KOH/g, a weight average molecular weight of 13,000 and a glass transition temperature of 62° C. is obtained.

Then, this in a melt state is delivered to CAVITRON CD1010 (trade name, produced by Eurotech Company) at a speed of 100 parts/min. Dilute ammonia water of a concentration of 0.37% which is obtained by diluting reagent ammonia water by ion exchange water is charged in a separately prepared aqueous medium tank, and is delivered at a speed of 0.1 l/min to the CAVITRON together with the melted polyester resin while being heated at 120° C. by a heat exchanger. The CAVITRON is operated under the conditions of a speed of rotation of a rotor of 60 Hz and pressure of 5 kg/cm$^2$, and thereby a dispersion liquid of an amorphous polyester resin, in which resin particles having an average particle diameter of 160 nm, a solid content of 30%, a glass transition temperature of 62° C. and a weight average molecular weight Mw of 13,000 are dispersed, is obtained.

(Preparation of Dispersion Liquid of Crystalline Polyester Resin)

Dodecane diacid (produced by Tokyo Kasei Kogyo Co., Ltd.): 92 parts

Hexane diol (produced by Wako Pure Chemical Industries, Ltd.): 58 parts

The monomers are charged in a flask, heated up to 160° C. over 1 hr, and, 0.03 parts of dibutyl tin oxide is charged after the inside of a reaction system is confirmed to be uniformly agitated. Furthermore, the temperature is elevated over 6 hrs from 160° C. up to 200° C. while distilling away the generated water, and a dehydration condensation reaction is further continued for 4 hrs at 200° C., and the reaction is brought to completion. After a reaction solution is cooled, a solid-liquid separation is carried out, and the obtained solid content is vacuum dried at 40° C., and, thereby a crystalline polyester resin is obtained.

The melting temperature of the obtained crystalline polyester resin is measured by using a differential scanning calorimeter DSC-7 (trade name, produced by Perkin-Elmer Corp.) and found to be 70° C. The weight average molecular weight is measured by using a molecular weight analyzer HLC-8020 (trade name, produced by Tosoh Corporation) with tetrahydrofuran (THF) as a solvent and found to be 15000.

Then, 50 parts of a crystalline polyester resin, 2 parts of anionic surfactant (trade name: NEOGEN SC, produced by Dai-Ichi Kogyo Seiyaku Co., Ltd.) and 200 parts of ion exchange water are heated to 120° C., then thoroughly dispersed by using ULTRA TURRAX T50 (trade name, produced by IKA Co., Ltd.), then dispersed by using a pressure discharge type homogenizer, and recovered when the volume average particle diameter becomes 180 nm. Thus, a crystalline polyester resin dispersion liquid having a solid content of 20% is obtained.

(Preparation of Dispersion Liquid of Coloring Agent)

Cyan pigment (Pigment Blue 15:3, produced by Dainichiseika Color & Chemicals, Incorporated): 10 parts Anionic surfactant (NEOGEN SC, produced by Dai-Ichi Kogyo Seiyaku Co., Ltd.): 2 parts Ion exchange water: 80 parts The components are blended and dispersed for 1 hr by using a high pressure impact dispersing unit Ultimizer (trade name: HJP30006, produced by Sugino Machine Ltd.,) and thereby a dispersion liquid of coloring agent that has a volume average particle diameter of 180 nm and a solid content of 20% is obtained.

(Preparation of Dispersion Liquid of Release Agent)

Paraffin wax (trade name: HNP-9, produced by Nippon Seiro Co., Ltd.): 50 parts

Anionic surfactant (NEOGEN SC, produced by Dai-Ichi Kogyo Seiyaku Co., Ltd.): 2 parts Ion exchange water: 200 parts The components are heated at 120° C., thoroughly blended and dispersed by using ULTRA TURRAX T50 (produced by IKA Co., Ltd.), followed by dispersing by using a pressure discharge type homogenizer, and, thereby, a dispersion liquid of release agent that has a volume average particle diameter of 200 nm and a solid content of 20% is obtained.

(Production of Toner Particles)

(Toner Particle 1)

Dispersion liquid of amorphous polyester resin: 150 parts

Dispersion liquid of crystalline polyester resin: 50 parts

Dispersion liquid of coloring agent: 25 parts

Polyaluminum chloride: 0.4 parts

Ion exchange water: 100 parts

The components are put in a stainless flask, thoroughly mixed and dispersed by using ULTRA TURRAX T50 (produced IKA Corporation) and heated up to 48° C. while agitating the flask by using a heating oil bath. The mixture liquid is kept at 48° C. for 60 min, and then 70 parts of the same dispersion liquid of amorphous polyester resin as that described above are gradually added thereto.

Thereafter, the pH in the system is adjusted to 8.0 by using a sodium hydrate aqueous solution having a concentration of 0.5 mol/L, the stainless flask is hermetically sealed, a seal of the agitation axis is magnetically sealed, and the system is heated to 90° C. and kept in that state for 3 hrs under continued agitation. After the reaction comes to completion, the system is cooled at a temperature-decrease speed of 2° C./min, followed by filtration and thorough washing with ion exchange water, further followed by solid-liquid separation by using a nutche type suction filtration. The obtained product is re-dispersed by using 3 L of ion exchange water having a temperature of 30° C. and the obtained liquid is agitated and washed at 300 rpm for 15 min. The washing operation is further repeated six times and, when the pH of the filtrate becomes 7.54 and the electric conductivity becomes 6.5 μS/cm, solid-liquid separation is conducted with a No. 5A filter paper by a nutche suction filtration. In the next place, vacuum drying is continued for 12 hrs and thereby toner particles 1 are obtained.

The volume average particle diameter D50v of the toner particles 1 is 5.7 μm, the average shape factor SF1 is 124, the proportion of particles having a shape factor SF1 of less than 125 is 45% by number and the proportion of particles having a shape factor SF1 of greater than 135 is 10% by number.

(Toner Particle 2)

Toner particles 2 are obtained in the same manner as the preparation of the production of the toner particles 1 except that the reaction at a pH of 8.0, 90° C. for 3 hrs. is replaced by a reaction at a pH of 8.5, 77° C. for 3 hrs.

The volume average particle diameter D50v of the toner particles 2 is 5.8 μm, the average shape factor SF1 is 132, the proportion of particles having a shape factor SF1 of less than 125 is 20% by number and the proportion of particles having a shape factor SF1 of greater than 135 is 35% by number.

(Toner Particle 3)

Toner particles 3 are obtained in the same manner as the preparation of the production of the toner particles 1, except that the reaction at a pH of 8.0, 90° C. for 3 hrs. is replaced by a reaction at a pH of 6.5 and a temperature of 75° C. for 1 hr and a subsequent reaction at a pH of 8.0 and a temperature of 82° C.

The volume average particle diameter D50v of the toner particles 3 is 5.7 μm, the average shape factor SF1 is 130, the proportion of particles having a shape factor SF1 of less than 125 is 7% by number and the proportion of particles having a shape factor SF1 of greater than 135 is 8% by number.

(Toner Particle 4)

Toner particles 4 are obtained in the same manner as the preparation of the production of the toner particles 1, except that the reaction at a pH of 8.0 and 90° C. is replaced by a reaction at a pH of 9.0 and a temperature of 75° C.

The volume average particle diameter D50v of the toner particles 4 is 5.8 μm, the average shape factor SF1 is 139, the proportion of particles having a shape factor SF1 of less than 125 is 5% by number, and the proportion of particles having a shape factor SF1 of greater than 135 is 75% by number.

(Preparation of Toner)

(Toner A)

The toner particles 1 (average shape factor: 124) and the toner particles 2 (average shape factor: 132) are mixed at a weight ratio of 2:8 and thereby mother particles A are obtained. The mother particles A have a volume average particle diameter of 5.8 μm and an average shape factor SF1 of 131, the proportion of particles having a shape factor SF1 of less than 125 is 25% by number and the proportion of particles having a shape factor SF1 of greater than 135 is 30% by number. To 100 parts of the mother particles A, 1 parts of titanium oxide having a volume average primary particle diameter of 20 nm and 2 parts of silicon oxide having a volume average primary particle diameter of 150 nm are added, and mixed by using a Henschel mixer at 3600 rpm for 10 min, whereby an external additive toner A is prepared.

(Toner B)

An external additive toner B is prepared in the same manner as the preparation of the external additive toner A, except that the toner particles 1 (average shape factor: 124) and the toner particles 2 (average shape factor: 132) are blended at a weight ratio of 3:7. The average shape factor SF1 is 130, the proportion of particles having a shape factor of less than 125 is 28% by number and the proportion of particles having a shape factor of greater than 135 is 28% by number (Toner C)

An external additive toner C is prepared in the same manner as the preparation of the external additive toner A, except that the toner particles 1 (average shape factor: 124) and the toner particles 2 (average shape factor: 132) are blended at a weight ratio of 4:6. The average shape factor SF1 is 129, the proportion of particles having a shape factor SF1 of less than 125 is 30% by number and the proportion of particles having a shape factor SF1 of greater than 135 is 25% by number.

(Toner D)

An external additive toner D is obtained in the same manner as the preparation of the external additive toner A except that the toner particles 3 are used in place of the toner particles 1 and the toner particles 2 used in the preparation of the toner A.

(Toner E)

A toner E is obtained in the same manner as the preparation of the toner A, except that (i) the toner particles 3 are used in place of the toner particles 1 and the toner particles 2, and (ii) a silicon oxide having a volume average primary particle diameter of 50 nm is used in place of the silicon oxide having a volume average primary particle diameter of 150 μm used in the preparation of the toner A.

(Toner F)

A toner F is obtained in the same manner as the preparation of the toner A, except that (i) the toner particles 3 are used in place of the toner particles 1 and the toner particles 2, and (ii) a silicon oxide having a volume average primary particle diameter of 230 nm is used in place of the silicon oxide having a volume average primary particle diameter of 150 nm used in the preparation of the toner A.

(Toner G)

A toner G is obtained in the same manner as the preparation of the toner A, except that only the toner particles 4 are used in place of the toner particles 1 and the toner particles 2 used in the preparation of the toner A.

(Toner H)

Mother particles H is obtained by mixing the toner particles 1 and the toner particles 2 at a weight ratio of 5:5. The volume average particle diameter of the mother particles H is 5.8 μm, the average shape factor SF1 is 129, the proportion of particles having a shape factor SF1 of less than 125 is 33% by number and the proportion of particles having a shape factor SF1 of greater than 135 is 23% by number. To 100 parts of the mother particles H, 1 parts of titanium oxide having a volume average primary particle diameter of 20 nm and 2 parts of silicon oxide having a volume average primary particle diameter of 150 nm are added, and mixed by using a Henschel mixer at 3600 rpm for 10 min, whereby an external additive toner H is prepared.

(Toner I)

A mother particle I is obtained by mixing the toner particles 1 and the toner particles 2 at a weight ratio of 1:9, The volume average particle diameter of the mother particles I is 5.8 μm, the average shape factor SF1 is 131, the proportion of particles having a shape factor SF1 of less than 125 is 23% by number and the proportion of particles having a shape factor SF1 of greater than 135 is 33% by number. To 100 parts of the mother particles I, 1 parts of titanium oxide having a volume average primary particle diameter of 20 nm and 2 parts of silicon oxide having a volume average primary particle diameter of 150 nm are added, and mixed by using a Henschel mixer at 3600 rpm for 10 min, whereby an external additive toner I is prepared.

(Preparation of Carrier)

(Carrier 1)

Mn—Mg ferrite particle (density: 4.6, volume average particle diameter: 35 μm): 100 parts Toluene: 10 parts Styrene/methyl methacrylate copolymer resin (copolymerization ratio: 90/10, Mw=100,000, scratch line width: 120 μm, scratch depth: 105 μm): 2.5 parts Carbon black (trade name: VXC-72, produced by Cabot Corporation): 0.5 parts Among the materials, the resin is diluted with toluene, carbon black is added thereto, and the mixture liquid is agitated by using a homogenizer for 5 min, whereby a resin solution is prepared. The resin solution and the ferrite particles are charged into a vacuum deaerating kneader, agitated at 90° C. for 20 min, and toluene is removed by depressurization. Cooling and agitation are continued until a temperature becomes 60° C., the resultant resin-coated carrier is taken out and sieved by using a sieving mesh having a mesh size of 75 μm, whereby a carrier 1 is obtained.

The thickness of the resin coated layer in the carrier 1 is 0.35 μm.

(Carrier 2)

A carrier 2 is obtained in the same manner as the preparation of the carrier 1, except that a styrene/cyclohexyl methacrylate copolymer resin (copolymerization ratio: 70/30, Mw: 150,000, scratch line width: 90 μm and scratch depth: 82 μm) is used as a coating resin in place of the styrene/methyl methacrylate copolymer resin used in the preparation of the carrier 1.

The thickness of the resin-coated layer in the carrier 2 is 0.32 μm.

(Carrier 3)

Mn—Mg ferrite particle (specific gravity: 4.6, volume average particle diameter: 35 μm): 100 parts Toluene: 20 parts Cyclohexyl methacrylate/vinyl pyrolidone copolymer resin (copolymerization ratio: 97/3, Mw: 150,000, Tg: 108° C., scratch line width: 73 μm, scratch depth: 55 μm): 2.5 parts Carbon black (VXC-72, produced by Cabot Corporation): 0.5 parts Melamine formaldehyde resin particle (trade name: EPOSTER S, produced by Nippon Shokubai Co., Ltd.): 0.3 parts Among the materials, the cyclohexyl methacrylate/vinyl pyrolidone copolymer resin is diluted with toluene, the carbon black and the melamine formaldehyde resin particles are added thereto and agitated for 5 min by using a homogenizer, whereby a resin solution is prepared. The resin solution and the ferrite particles are charged in a vacuum deaerating kneader, agitated at 80° C. for 30 min, and toluene is removed by depressurization. Thereafter, the resultant product is left in a thermostat bath set at 80° C. for 7 hrs to form a film on surfaces of the ferrite particles, so that a carrier 3 is obtained.

The thickness of the resin coated layer in the carrier 3 is 0.41 μm.

(Carrier 4)

A carrier 4 is obtained in the same manner as the preparation of the carrier 1 except that a polymethyl methacrylate resin (Mw: 120,000, Tg: 102° C., scratch line width: 50 μm and scratch depth: 48 μm) is used as a coating resin in place of the cyclohexyl methacrylate/vinyl pyrolidone copolymer resin used in the preparation of the carrier 3.

The thickness of the resin-coated layer in the carrier 4 is 0.38 μm.

(Preparation of Developer)

The respective toners and the respective carriers are combined as shown in Table 1. In each combination, 7 parts of the toner and 93 parts of the carrier are mixed and agitated by using a V blender at 40 rpm for 20 min, whereby the respective developers are prepared.

Example 1

A developer (1) obtained by combining the carrier 1 and the toner A as shown in Table 1 is charged in a developing unit of DOCU CENTRE COLOR A450 (trade name, produced by Fuji Xerox Co., Ltd.), and a copying test is conducted. First a 2 cm×5 cm solid image is copied under an environment of 22° C. and 50% RH, and the developer on the sleeve is sampled. The particle diameters and the charge amounts are measured by using E-SPART ANALYZER, and the surface charge density distribution D expressed by the Formula (1) is calculated.

In the next place, an image described below is output up to 100,000 sheets by continuous printing. During the continuous printing, the number of sheets at which fog in a background portion is generated and the number of sheets at which in-machine contamination occurs are obtained. The fog in a background portion and the in-machine contamination are evaluated based on the following criteria.

(Fog in Background Portion)

An image having two 2 cm×5 cm solid images is copied, an apparatus is forcibly stopped before it is transferred onto paper, and fogging toner particles in a background portion at a position at a distance of about 10 mm from the solid image on a photoreceptor surface is transferred by using the adhesion property of a tape. The number of toner particles per 1 $cm^2$ on the tape is counted, and when the number becomes 10 or more, the printing quality is evaluated as defective. A target total number is 150,000 sheets or more.

(In-Machine Contamination)

An OHP sheet is adhered at an upper portion of the developing unit and the density of the toner (as an image density) deposited on the OHP sheet is measured every definite number of prints by using X-RITE 404 (trade name, produced by X-reite Corporation). In-machine contamination quality is evaluated as defective when the toner density on the OHP becomes 0.02 or more. A target total number is 150,000 sheets or more.

(Developability)

The same image as that used for the evaluation of background portion fogging is used to prepare an unfixed image, the amount of the toner contained in the unfixed image is measured, and the developability is evaluated based on the criteria described below. The amount of the toner is measured according to the following method. The 2 cm×5 cm image having the unfixed toner is cut together with the sheet and a weight thereof (including the weight of the sheet) is measured and indicated by X. Then, an air gun is used to blow the toner off the cut-out image, the weight of the remaining sheet is measured and indicated by Y, and the amount of the toner contained in the unfixed image is expressed by $(X-Y)/10$ ($mg/cm^2$). The ranks A to C are assumed to be acceptable.

A: The amount of toner contained in the unfixed image is 95% or more of the initial value.

B: The amount of toner contained in the unfixed image is 90% or more but less than 95% of the initial value.

C: The amount of toner contained in the unfixed image is 85% or more but less than 90% of the initial value.

D: The amount of toner contained in the unfixed image is less than 85% of the initial value.

(Image Unevenness)

After 100,000 prints, the image used for the evaluation of the background portion fogging is output and the image unevenness of the solid portion is visually evaluated based on the criteria described below. Ranks A to C are assumed to be acceptable.

A: Image unevenness is not found in the solid portion.

B: Slight image unevenness is found in the solid portion.

C: Image unevenness is found in the solid portion, but within a permissible range.

D: Unacceptable image unevenness is found in the solid portion.

Furthermore, after an image forming apparatus is left in an environmental chamber of 28° C. and 85% RH for 24 hrs, the test is carried out in the same manner in the environment. The results are summarized in Table 1. In the Table, the results of evaluations by using an actual machine under an environment of 22° C. and 50% RH are shown in the upper section of the row for each sample and results of evaluations by using an actual machine under an environment of 28° C. and 85% RH are shown in the lower section of the row for each sample. Samples that cause a problem under an environment of 22° C. and 50% RH are not subjected to the test under an environment of 28° C. and 85% RH.

Examples 2 to 7

Comparative Examples 1 to 5

The evaluations are carried out in the same manner except that the respective developers obtained by combining the carriers and toners shown in Table 1 are respectively used in place of the developer (1) in example 1. The results are summarized in Table 1.

As shown in Table 1, in Examples, fog in a background portion and in-machine contamination are stable without causing significant problems and image quality is not problematic, either, under both of a normal temperature and normal humidity environment and a high temperature and high humidity environment. On the other hand, problems are caused in Comparative Examples in at least one of the plural evaluation items.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developer, comprising:

a toner containing an external additive; and a carrier comprising a resin-coated layer formed on a surface of a core material, wherein a resin that forms the resin-coated layer contains a copolymer of a monomer containing (i) a cycloalkyl group and (ii) a styrene monomer or dimethylamino methacrylate, an average shape factor SF1 of the toner being from about 125 to about 135,

TABLE 1

| | Carrier | | | Toner | | | | | | Actual Machine Evaluation | | | |
|---|---|---|---|---|---|---|---|---|---|---|---|---|---|
| | No | Scratch Line Width (μm) | Scratch Depth (μm) | No | average SF1 | Particles having SF1 of less than 125 (%) | Particles having SF1 of greater than 135 (%) | Particle Diameter of Large-Diameter External Additive (nm) | Surface Charge Density Distribution (dB) | Development property | Image Unevenness | Number of Sheets where Fog on Background Portion is caused (sheets) | Number of Sheets where In-Machine Contamination is caused (sheets) |
| Example 1 | 1 | 120 | 105 | A | 131 | 25 | 30 | 150 | 5.1 | B | B | none | none |
| | | | | | | | | | 5.5 | B | C | 160000 | 160000 |
| Example 2 | 1 | 120 | 105 | B | 130 | 28 | 28 | 150 | 5.4 | B | B | none | none |
| | | | | | | | | | 5.7 | C | C | 170000 | 160000 |
| Example 3 | 1 | 120 | 105 | C | 129 | 30 | 25 | 150 | 5.6 | B | B | none | none |
| | | | | | | | | | 6.1 | B | C | 170000 | 170000 |
| Example 4 | 1 | 120 | 105 | D | 130 | 7 | 8 | 150 | 7.1 | A | A | none | none |
| | | | | | | | | | 7.4 | A | B | 190000 | none |
| Example 5 | 1 | 120 | 105 | E | 130 | 7 | 8 | 50 | 7.2 | A | B | none | none |
| | | | | | | | | | 7.6 | A | C | 190000 | 170000 |
| Example 6 | 1 | 120 | 105 | F | 130 | 7 | 8 | 230 | 6.8 | A | A | none | none |
| | | | | | | | | | 7.0 | A | B | 170000 | 190000 |
| Example 7 | 2 | 90 | 82 | D | 130 | 7 | 8 | 150 | 6.2 | A | A | none | none |
| | | | | | | | | | 6.5 | A | A | 180000 | 190000 |
| Comparative Example 1 | 1 | 120 | 105 | G | 139 | 5 | 75 | 150 | 2.6 | C | C | 90000 | none |
| | | | | | | | | | 3.3 | — | — | — | — |
| Comparative Example 2 | 1 | 120 | 105 | H | 129 | 33 | 23 | 150 | 5.8 | B | B | none | none |
| | | | | | | | | | 6.4 | B | C | 130000 | 130000 |
| Comparative Example 3 | 1 | 120 | 105 | I | 131 | 23 | 33 | 150 | 4.5 | B | B | none | none |
| | | | | | | | | | 4.7 | C | C | 130000 | 130000 |
| Comparative Example 4 | 3 | 73 | 55 | D | 130 | 7 | 8 | 150 | 7.0 | A | B | 90000 | 90000 |
| | | | | | | | | | 4.8 | — | — | — | — |
| Comparative Example 5 | 4 | 50 | 48 | D | 130 | 7 | 8 | 150 | 6.9 | A | B | 70000 | 70000 |
| | | | | | | | | | 4.4 | — | — | — | — |

a number of particles having a shape factor SF1 of less than 125 being from about 5% to about 30% by number with respect to a total number of toner particles, a number of particles having a shape factor SF1 of greater than 135 being from about 5% to about 30% by number with respect to the total number of toner particles, a scratch line width in a scratch strength test of the resin used in the resin-coated layer being from about 80 μm to about 200 μm, and a scratch depth being from about 60 μm to about 150 μm.

2. The electrostatic charge image developer of claim 1, wherein the resin that forms the resin-coated layer is a resin obtained by polymerizing a monomer containing a styrene monomer.

3. The electrostatic charge image developer of claim 1, wherein a glass transition temperature of the resin that forms the resin-coated layer is from about 70° C. to about 150° C.

4. The electrostatic charge image developer of claim 1, wherein the cycloalkyl group has a 3- to 10-membered ring structure.

5. The electrostatic charge image developer of claim 1, wherein the cycloalkyl group contains any one of a cyclohexyl group, an adamantyl group, a cyclopropyl group, a cyclobutyl group, a cyclopentyl group, a cyclohexyl group, a cycloheptyl group, a cyclooctyl group, a cyclononyl group, a cyclodecyl group, an isobornyl group, a norbornyl group and a bornyl group.

6. The electrostatic charge image developer of claim 1, wherein the resin that forms the resin-coated layer is formed by copolymerizing dimethylamino methacrylate in the range of from about 0.5 parts by weight to about 5 parts by weight.

7. The electrostatic charge image developer of claim 1, wherein an average film thickness of the resin-coated layer is about 70 nm or more.

8. The electrostatic charge image developer of claim 1, wherein a volume resistivity of the carrier is from about $1\times10^{7}$ Ω·cm to about $1\times10^{15}$ Ω·cm.

9. The electrostatic charge image developer of claim 1, wherein the metal oxide particles are monodispersed spherical silica.

10. The electrostatic charge image developer of claim 1, wherein a standard deviation of the particle diameters of the metal oxide particles is about D50×0.22 or less.

11. The electrostatic charge image developer of claim 1, wherein a Wadell's sphericity of the metal oxide particles is about 0.6 or more.

12. The electrostatic charge image developer of claim 1, wherein, after leaving a developer in an environment having a temperature of 22° C. and a relative humidity of 50% for 170 hours, a surface charge density distribution D shown by Formula (1) below of the toner is about 5 dB or more $$D\,[\mathrm{dB}]=10\times\log(m^2/\sigma^2) \qquad \text{Formula (1):}$$

in the Formula (1), m expresses an average value of surface charge density of the toner, and σ expresses the standard deviation of the surface charge density of the toner.

13. The electrostatic charge image developer of claim 1, wherein the toner contains a crystalline polyester resin.

14. The electrostatic charge image developer of claim 13, wherein an acid component of the crystalline polyester resin comprises about 95% by mole or more of straight chain dicarboxylic acid having 6 to 10 carbon atoms.

15. The electrostatic charge image developer of claim 13, wherein an alcohol component of the crystalline polyester resin comprises about 95% by mole or more of straight chain dialcohol having 6 to 10 carbon atoms.

16. The electrostatic charge image developer of claim 13, wherein a content of the crystalline polyester resin in the toner is from about 3% by weight to about 20% by weight.

17. The electrostatic charge image developer of claim 1, wherein a volume average particle size distribution index GSDv of the toner is about 1.30 or less.

18. The electrostatic charge image developer of claim 1, wherein the external additive comprises metal oxide particles having a volume average primary particle diameter of from 70 nm to 200 nm.

19. The electrostatic charge image developer of claim 1, wherein the resin that forms the resin-coated layer is derived from cyclohexyl (meth)acrylate.

* * * * *